United States Patent [19]

Horn et al.

[11] 4,243,379

[45] Jan. 6, 1981

[54] SHAFT PREHEATER

[75] Inventors: Hannes S. Horn, Dortmund; Heinrich Buchner, Bochum-Weitmar, both of Fed. Rep. of Germany

[73] Assignee: Klockner-Humboldt-Deutz AG, Fed. Rep. of Germany

[21] Appl. No.: 18,631

[22] Filed: Mar. 8, 1979

[30] Foreign Application Priority Data

Feb. 2, 1979 [DE] Fed. Rep. of Germany ..... 2900078

[51] Int. Cl.[3] ..... F27B 15/00

[52] U.S. Cl. ..... 432/14; 432/58; 432/98; 432/106

[58] Field of Search ..... 432/14, 15, 58, 95, 432/98, 106

[56] References Cited

U.S. PATENT DOCUMENTS

| | | | |
|---|---|---|---|
| 3,027,147 | 3/1962 | Brakel et al. | 432/98 |
| 3,503,790 | 3/1970 | Gringras | 432/14 |
| 4,025,296 | 5/1977 | Buchner | 432/58 |

FOREIGN PATENT DOCUMENTS

| | | | |
|---|---|---|---|
| 1454858 | 8/1966 | France | 432/95 |
| 1600933 | 8/1970 | France | 432/95 |

*Primary Examiner*—John J. Camby

*Attorney, Agent, or Firm*—Hill, Van Santen, Steadman, Chiara & Simpson

[57] ABSTRACT

A mechanism and method for preheating a coarse fraction and a more fine limestone fraction in a shaft preheater including a first central vertical inlet for receiving the coarse fraction which forms a descending core in a vertical preheating chamber, and a second vertical inlet receiving the finer fraction annularly around the core, directing a first upper gas feed radially into the fractions with the gas first penetrating the outer finer fraction and then the inner fraction, and directing a second heating gas flow at a lower level into the core to bring the core up to the temperature of the outer layer, with the gases being received from a rotary kiln, and mixing the fractions and directing them to the rotary kiln from the lower end of the preheating chamber.

18 Claims, 1 Drawing Figure

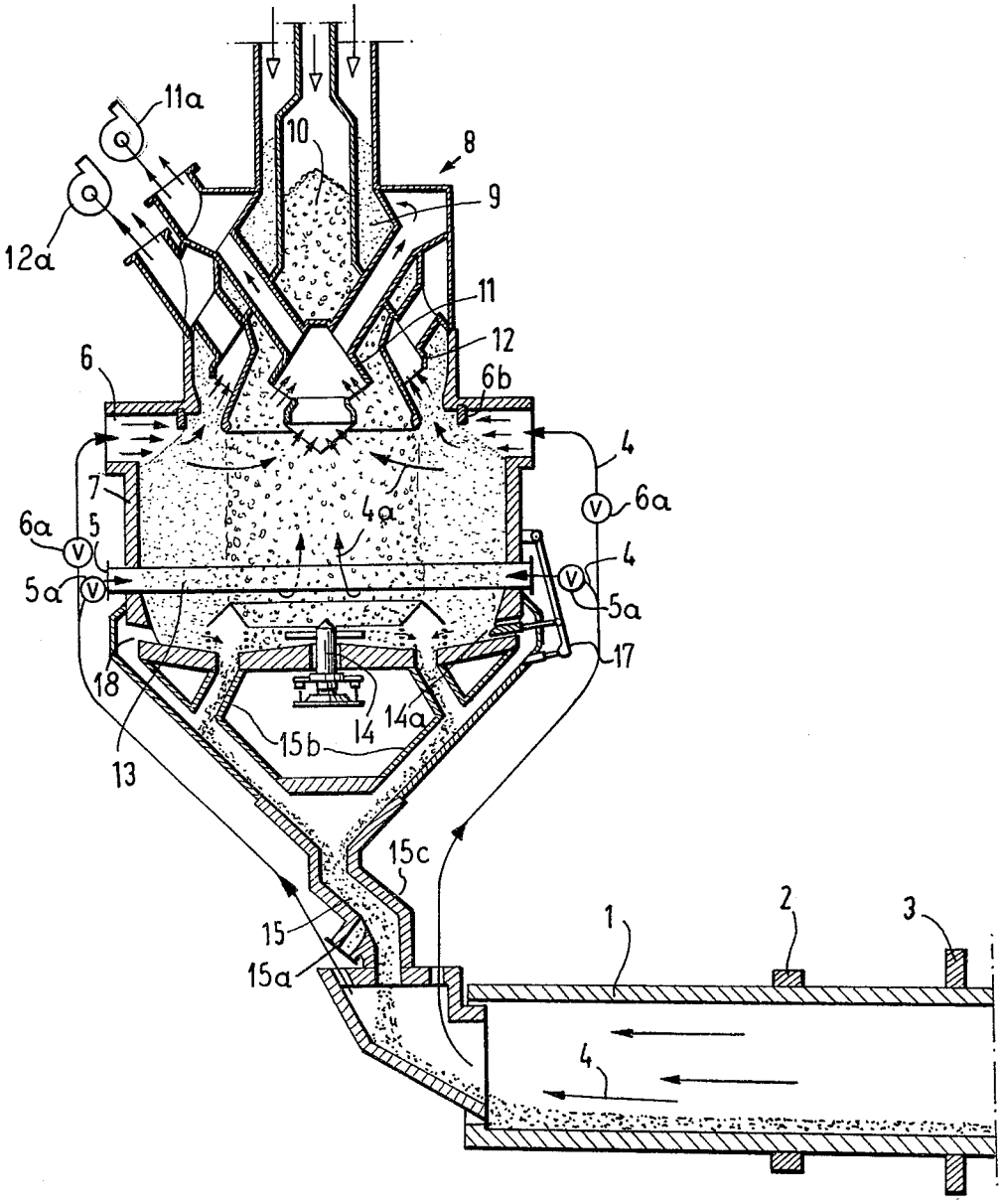
11a
10
8
9
12a
11
12
6
6b
4
7
6a
4a
6a
5
4
5a
5a
17
18
14a
14
15b
13
15c
15
15a
1
2
3
4

SHAFT PREHEATER

BACKGROUND OF THE INVENTION

The present invention relates to improvements in shaft preheaters for rotary kilns or the like, and more particularly to an improved shaft preheater capable of preheating two different lime fractions of different grain size.

The shaft preheater has an arrangement wherein more coarse and more fine limestone materials are introduced into the upper end of a preheating chamber with the lower end of the preheating chamber discharging to the kiln.

In the arrangements of shaft preheaters of the general above referred to type, it has been heretofore been not possible to utilize transverse flows of heating gas directed into the upper portion of the shaft preheater to equally heat different material fractions. In conventional arrangements, when the coarse material fraction enters the preheater at an inner location, the hot gases which contact the coarse material have already cooled off after passage through the outer fine fraction. The result of this is that the outer fine fraction is precalcined and the inner coarse fraction receives too small a portion of the quantity of heat available so that as the material enters the rotary kiln, a further heating of the coarse fraction must first take place before it is calcined.

SUMMARY OF THE INVENTION

It is an object of the present invention to provide an improved shaft preheater and a method of precalcining different fractions of limestone so that the coarse fraction is equally precalcined with the fine fraction and the two fractions reach the kiln with equal degrees of precalcination and at equal temperatures.

In the present arrangement, the advantages of the transverse flow through of gases through the two fractions is utilized. However, with the present arrangement, an objective is to provide the discharge temperature of both fractions whereby the fine grained fraction is not superheated, and the coarse fraction is not underheated, but both fractions are heated to an equal degree.

The objective set forth above is attained by a method and arrangement wherein the preheater is arranged so that an additional lower hot gas feed is provided spaced downwardly from the upper hot gas feed. The lower gas feed is directed into the inner core of the coarse material countercurrent to the flow of material. The lower flow equalizes the nonuniform heating of current transverse flow types of shaft preheaters, and with the discharge of material at uniform temperature no additional early subsequent heating of the coarse fraction must take place in the rotary kiln.

In accordance with the invention, the lower hot gas feed is positioned directly above the discharge from the preheat chamber. In this arrangement, the path that the additional introduced hot gases must travel is as long as possible. In the coarse fraction of limestone, the flow resistance of the hot gases through the loose material is substantially less than the fine fraction and, therefore, with the long flow path, the same drop in pressure occurs as in the shorter flow path of the gases flowing through the more fine material in the upper portion of the shaft preheater. The gas flows, and the division of gas flows, can take place advantageously without additional conveyor or feed means.

In accordance with the invention further, a gas-tight closure is arranged downstream from the discharge from the preheater. In a preferred arrangement, the entire quantity of gas is received from the kiln and arrives only through two hot gas feeds into the preheater. A desired flow through of gases takes place undisturbed by the gases rising through the material discharge, and the gases rising are not nonuniform which would prevent uniform flow through in the preheater. This contributes to an especially stable behavior in operation.

In accordance with the invention, the lower hot gas feed is constructed as a hollow conduit with outlet openings arranged in the center to discharge into the core of the more coarse material. The lower gas feed is discharged into the more loose material at the center of the preheater. The outlet openings from the discharge end of the preheater are preferably arranged in the center, and the coarse fraction is preferably fed in so that it remains in the center in its flow through the preheater. Outlet openings may also be arranged in the area of the fine fraction annularly around the center core in order to produce an edge flow for covering of losses by radiation.

In accordance with the invention, it is preferred that 10% to 50% of the total hot gas flow and more optimumly 30% are directed to the lower gas feed. It has been found that with the introduction of about 30% of the hot gas flow from the kiln into the lower part of the shaft preheater, a particularly favorable end temperature distribution of the preheated material is attained. This distribution of quantities is attainable through a correspondingly simple feed determination. The value of 30% is suitable for the normal distribution of loose material. If a higher portion of fines is present, the hot gas feed in the lower shaft preheater is lowered to 10% while a high portion of coarse material requires up to 50% of the entire amount of gas flow to be introduced into the lower hot gas feed.

In a further preferred form of the invention, a preheater chamber which extends vertically and spaced between the two hot gas feeds is preferably cylindrical in shape. Thus, for the rising gases, the same cross-flow sections are maintained in a vertical direction. With this construction, a uniform flow with low speed is attained in the lower part of the preheater. Also, the room for the discharge apparatus is enlarged. The rise in duration time of preheating, particularly for the fine material in the shaft preheater, was not found to be harmful. The preheating can take place relatively independently of the duration time, and superheating due to transverse flow of countercurrent combinations with other heat transfers are prevented.

Other objects, advantages and features of the invention as well as equivalent structures and methods which are intended to be covered herein, will become more apparent with the teaching of the principles of the present invention in connection with the description of the preferred embodiment as illustrated in the drawings.

DRAWINGS

FIG. 1 is the sole drawing being a cross-section through a shaft preheater constructed and operating in accordance with the principles of the present invention, the section being vertical.

DESCRIPTION

The apparatus includes a conventional rotary kiln 1, a diagrammatically indicated supporting bearing race 2, and driving gear ring 3. The paths of flow of the hot gases through the kiln and upwardly therefrom are shown by the arrowed lines 4. The arrowed lines 4 which extend upwardly from the kiln to a preheater chamber 7 actually represent conduits which conduct the flow of hot gas upwardly.

Part of the upward flow of gases from the kiln is fed into the lower hot gas feed 5, and the remainder of the hot gases into the upper hot gas feed 6. These gas feeds lead into the side wall of the preheater which is preferably cylindrical in shape. An overhead lip **6*b* provides a deflection for the descending fine material. The upper hot gas feeds 6 are shown as radially inwardly extending openings and it will be understood that with a cylindrical preheater chamber 7, a plurality of circumferentially spaced radially inwardly leading inlets 6 may be provided. Similarly, while single diametrically opposed lower hot gas inlets 5** are shown, a plurality of radially inwardly extending and circumferentially spaced inlets may be provided in some instances.

At the upper end of the preheater, the material, such as limestone, is introduced and the introduction area is generally indicated by the numeral 8.

At the upper end, a first vertical inlet is arranged for the introduction of the more coarse material fraction which forms a central core 10. The more fine fraction is introduced annularly around the central core, and the annular outwardly located more fine layer of limestone is shown at 9. The finer outer layer of material 9 flows downwardly retaining its outer annular position, and the more coarse material 10 flows downwardly retaining its central core location. As both the coarser and finer materials enter the upper end of the chamber 7, they are penetrated by radially inwardly flowing hot gases introduced through the upper gas inlets 6. As the gas flows inwardly, it first heats the outer more fine layer and is somewhat cooled as heat is transferred to the more fine material and then penetrates the central more coarse layer. The upper hot gas feed 6 is provided with gas withdrawal means for the heated gases to flow upwardly and outwardly after they have penetrated and transferred heat to the limestone. A gas withdrawal ring 12 is provided with an outlet conduit. The gas flow upwardly through the coarser material flows through a gas collecting hood 11 which has an outlet conduit. To apportion and control the flow of gases through the withdrawal ring 12 and the hood 11, suction blowers are provided such as shown at **11*a* and 12*a***. By the control of the flow of exhaust gases, additional control of temperature is attained to obtain a uniform temperature of the coarse and fine material at the outlet.

In the lower portion of the shaft preheater is the cross conduit 5 for the lower gas feed. The conduit 5 is provided with central downwardly opening outlets so that the gas will flow as indicated by the arrowed lines **4*a* into the coarse material and rise upwardly therethrough toward the hood 11**.

The hot gas for the inlets 5 and 6 is supplied from the kiln; control valves **5*a* and 6*a* are in the gas lines to apportion the gas flow and preferably 10% to 50%, optimumly 30% in many instances, of the gas is fed into the lower inlet 5, with the remainder being sent up to the inlet 6**.

The material after being preheated is discharged downwardly and flows down the branch passages **15*b* to the passage 15 and down into the rotary kiln 1. Means may be provided in the passage 15, shown schematically at 15*c*, for the removal of dust from the material. The passage 15 is also provided with a gas shut-off apparatus shown schematically at 15*a* which prevents the free flow of hot gases from the kiln from flowing upwardly through the passage 15**. The gas seal is not shown in detail, but may be a double pendulum flap type valve.

For discharge of the coarse and fine materials, they are mixed to flow down into the conduit 15. For this purpose, an annular ring 16 is provided which has a downwardly and outwardly flaring conical shape. The ring 16 is constructed so that its upwardly extending apex is at the outer edge of the core of the coarse material, so that as the coarse and fine material cascade down over the surfaces of the ring 16, they mix beneath the ring to flow downwardly through the outlets **15*b*** which are centrally located under the ring.

The arrangement contemplates the control of the apportionment of flow of the coarse material and fine material. For this purpose, a valve means 14 is provided with the centrally located valve means 14 controlling the flow of coarse material. This valve means may take various forms, but it is indicated schematically as being a circular disk which can be raised or lowered to decrease or increase the flow of coarse material. A valve means for the fine material is also shown at **14*a*, being positioned at an outer edge of the annular arrangement of fine materials controlling flow through outer peripheral openings 18 and increased peripheral flow components for radiation heat losses at the outer surface of the fine material. A control arm 17** for the valve moves the arrangement in or out to change the quantity of flow of fine material.

In operation, coarse material is fed into the center of the upper end to form a core 10. More fine material is fed downwardly to form an annular ring 9 around the core. As the material descends downwardly, an upper hot gas feed is supplied through the inlets 6 to penetrate the more fine material first and then the more coarse material. After penetration of the fine material, some of the gases are drawn off through the collecting ring 12, and the remainder of the gases which flow inwardly through the more coarse material are drawn off through the hood 11. The gases cool in transferring heat to the outer ring or more fine material, and while they contribute some heat to the central core of more coarse material, some of the heat energy has been lost. To compensate for this, additional hot gases are introduced through the lower hot gas feed 5 into the center core to flow upwardly over a longer path through the coarser more porous material. The materials mix at the lower end of the chamber 7 and the temperatures of the coarse material and fine material are the same. Control is attained both from the flow of gases through the material and the removal of gases at the upper end, as well as the control of flow of material through the lower end of the chamber.

The shaft preheater according to the invention makes possible uniform preheating of different material fractions with exactly controllable heat introduction into the particular fraction. This is well suited for preheating of lime, dolomite and similar materials. The process and apparatus is particularly well adapted to preheating in the calcination processes with a relatively low average temperature with the complete heating of the coarse grain fraction being attained.

We claim:

1. In a shaft preheater for use with a rotary kiln or the like for the simultaneous preheating of two limestone fractions of different grain size with a first vertical inlet means for receiving a first fraction introduced therein;

a second vertical inlet means for receiving a second fraction arranged annularly around said first inlet means;

a vertical chamber positioned for receiving descending flow from said first and second inlet means;

a discharge outlet means in the lower end of said chamber;

an upper hot gas feed means leading into the upper portion of said chamber so that hot gas flows inwardly through both of said fractions;

and an exhaust means for removing the hot gas, an improvement comprising:

a lower hot gas feed means leading into the lower portion of said chamber with centrally located outlets so that hot gas flows upwardly essentially through only the first fraction.

2. The shaft preheater for a rotary kiln or the like constructed in accordance with claim 1:

wherein said lower gas feed means is positioned directly above said outlet means.

3. The shaft preheater for a rotary kiln or the like constructed in accordance with claim 2:

including a gas-tight closure beneath said discharge outlet means so that gas is fed into the chamber only through said upper and lower gas feed means.

4. The shaft preheater for use with a rotary kiln or the like constructed in accordance with claim 1:

wherein said lower gas feed means includes a radially inwardly extending conduit with said gas discharge outlets located thereon in the center of said chamber so that the gas flows upwardly through essentially only the first fraction.

5. The shaft preheater for use with a rotary kiln or the like constructed in accordance with claim 4:

including a gas supply for said upper and lower gas feeds with means for controlling the flow from said gas supply so that 10% to 50% of the total hot gas is directed to said lower hot gas feed means.

6. The shaft preheater for a rotary kiln or the like constructed in accordance with claim 1:

wherein said vertical chamber is cylindrical and said discharge outlet means includes two spaced apart discharge ports.

7. The shaft preheater for a rotary kiln or the like such as for the simultaneous preheating of two limestone fractions of different grain size with a first vertical central inlet means for receiving a first fraction introduced therein forming a central downwardly flowing core of material;

a second vertical inlet means for receiving a second fraction arranged annularly around said first inlet means to provide an annular ring of material around said core;

a vertical chamber positioned for receiving the descending flows of first and second fractions of material;

a discharge outlet in the lower end of said chamber;

an upper hot gas feed means having an inlet directed radially into the upper portion of the vertical chamber so that the hot gas flows inwardly through both of said fractions;

and exhaust means for removing the hot gas, an improvement comprising:

a lower hot gas feed means positioned adjacent the discharge outlet and adjusted to discharge hot gas into the center core of downwardly flowing material in said chamber so that the temperature of the central core is brought up to the level of the temperature of the second fraction annularly of the second surrounding the central core.

8. A shaft preheater for a rotary kiln or the like constructed in accordance with claim 7:

wherein said lower gas feed means includes an elongated conduit extending through the vertical chamber, adjacent the discharge outlet with a plurality of centrally located gas outlets.

9. A shaft preheater for a rotary kiln or the like constructed in accordance with claim 8:

said gas feeds; including means for apportioning the gas flow between said upper and lower gas feed means so that 10% to 50% of the gas that flows into the vertical chamber is directed to said lower feed means and the remainder to the upper feed means.

10. A shaft preheater for a rotary kiln or the like constructed in accordance with claim 8:

including first and second valve means located at the chamber outlet for controlling flow of said first and second fractions respectively.

11. A shaft preheater for a rotary kiln or the like constructed in accordance with claim 10:

including means for mixing said fractions at said outlet from the chamber.

12. A shaft preheater for a rotary kiln or the like constructed in accordance with claim 7:

including an annular ring having a downwardly flaring conical shape and being of an annular size to be located between said first and second fractions adjacent said outlet with the fractions mixing beneath said ring.

13. A shaft preheater for a rotary kiln or the like constructed in accordance with claim 12:

wherein said lower hot gas feed means includes annularly arranged outlets located between said fractions.

14. The method of preheating separate first and second limestone fractions of different sizes for a rotary kiln or the like, comprising the steps:

feeding the first fraction downwardly forming a core and feeding the second fraction downwardly outwardly annularly surrounding the core;

directing an upper flow of hot gas into the fractions radially to penetrate the outer second fraction and thereafter the inner first fraction with the gas first heating the annular outer fraction;

directing a lower flow of hot gas into the inner core of the first fraction shortly before mixing the fractions so that additional heat energy is directed into the inner core;

and mixing the fractions and directing them to a kiln.

15. The method of preheating separate first and second limestone fractions of different sizes for a rotary kiln or the like in accordance with the steps of claim 14:

wherein the gases which are directed into the fractions are obtained from the kiln.

16. The method of preheating separate first and second limestone fractions of different sizes for a rotary kiln or the like in accordance with the steps of claim 15:

wherein 10% to 50% of the gases received from the kiln are used for said lower flow of gas into the inner core.

17. The method of preheating separate first and second limestone fractions of different sizes for a rotary kiln or the like in accordance with the steps of claim 15:

wherein substantially 30% of the gas received from the kiln is directed into the inner core and the remainder is directed into the outer annular second fraction.

18. The method of preheating separate first and second limestone fractions of different sizes for a rotary kiln or the like in accordance with the steps of claim 14:

wherein said first fraction is a coarse material more coarse than the second fraction.

* * * * *